US008507105B2

(12) United States Patent
Jarosinski et al.

(10) Patent No.: US 8,507,105 B2
(45) **Date of Patent: *Aug. 13, 2013**

(54) THERMAL SPRAY COATED ROLLS FOR MOLTEN METAL BATHS

(75) Inventors: William Jarosinski, Carmel, IN (US); John Quets, Indianapolis, IN (US); Daming Wang, Carmel, IN (US); Vladimir Belov, Zionsville, IN (US); Ardy Simon Kleyman, Carmel, IN (US)

(73) Assignee: Praxair S.T. Technology, Inc., North Haven, CT (US)

( * ) Notice: Subject to any disclaimer, the term of this patent is extended or adjusted under 35 U.S.C. 154(b) by 642 days.

This patent is subject to a terminal disclaimer.

(21) Appl. No.: 11/498,054

(22) Filed: Aug. 3, 2006

(65) Prior Publication Data

US 2007/0087205 A1 Apr. 19, 2007

Related U.S. Application Data

(60) Provisional application No. 60/725,631, filed on Oct. 13, 2005.

(51) Int. Cl.

| | |
|---|---|
| ***B32B 15/16*** | (2006.01) |
| ***C22C 29/06*** | (2006.01) |
| *B05D 1/12* | (2006.01) |

(52) U.S. Cl.

USPC ..... 428/558; 428/550; 428/551; 428/553; 428/564

(58) Field of Classification Search

None

See application file for complete search history.

(56) References Cited

U.S. PATENT DOCUMENTS

| | | | | |
|---|---|---|---|---|
| 2,714,563 | A | 8/1955 | Poorman et al. | |
| 4,519,840 | A | 5/1985 | Jackson et al. | |
| 4,626,476 | A * | 12/1986 | Londry et al. | 428/457 |
| 4,626,477 | A | 12/1986 | Jackson et al. | |
| 5,116,431 | A | 5/1992 | Suhara et al. | 148/530 |
| 5,316,859 | A | 5/1994 | Harada et al. | 428/472 |
| 5,364,331 | A | 11/1994 | Higashino et al. | 492/43 |

(Continued)

FOREIGN PATENT DOCUMENTS

| | | | |
|---|---|---|---|
| DE | EP 0687746 | A1 * | 12/1995 |
| JP | 56-112447 | A | 9/1981 |

(Continued)

OTHER PUBLICATIONS

Nature of Thermal Spray Coatings, Internet Archive of http://www.gordonengland.co.uk/tsc.htm archived Feb. 22, 2001.*

(Continued)

*Primary Examiner* — Jennifer McNeil
*Assistant Examiner* — Adam Krupicka
(74) *Attorney, Agent, or Firm* — Nilay S. Dalal

(57) ABSTRACT

This invention relates to rolls for use in or in contact with molten metal comprising a roll drum having an outer peripheral surface and a thermally sprayed coating on the outer peripheral surface of said roll drum, said thermally sprayed coating comprising from about 66 to about 88 weight percent of tungsten, from about 2.5 to about 6 weight percent of carbon, from about 6 to about 20 weight percent of cobalt, and from about 2 to about 9 weight percent of chromium; a process for preparing the rolls; a method for forming a metal layer on a metal sheet utilizing the rolls, e.g., galvanization; and a thermal spray powder for coating the outer peripheral surface of the rolls.

23 Claims, 1 Drawing Sheet

(56) References Cited

U.S. PATENT DOCUMENTS

| | | | | |
|---|---|---|---|---|
| 5,391,135 | A | 2/1995 | Kuroki et al. | 492/35 |
| 5,397,650 | A | 3/1995 | Harada et al. | 428/552 |
| 5,736,255 | A | 4/1998 | Sasaki et al. | 428/469 |
| 5,869,144 | A | 2/1999 | Stavros | 427/376.2 |
| 6,199,281 | B1 | 3/2001 | Lee et al. | 29/895.32 |
| 6,503,290 | B1 | 1/2003 | Jarosinski et al. | |
| 2002/0119343 | A1 * | 8/2002 | Betts | 428/651 |
| 2004/0194662 | A1 | 10/2004 | Itsukaichi et al. | 106/286.3 |

FOREIGN PATENT DOCUMENTS

| | | |
|---|---|---|
| JP | 58-025468 | 2/1983 |
| JP | 01-225761 | 3/1988 |
| JP | 03-064460 | 3/2003 |
| WO | WO 2005068099 A1 * | 7/2005 |

OTHER PUBLICATIONS

English translation of EP0687746 translated and printed Jul. 20, 2012.* h. Mizuno et al., "Development of durable spray coatings in molten aluminum alloy", *ITSC 2005:Thermal Spray Conference & Exposition in the Conference Proceedings* (*ISBN 3-87155-793-5*), May 2005.

* cited by examiner

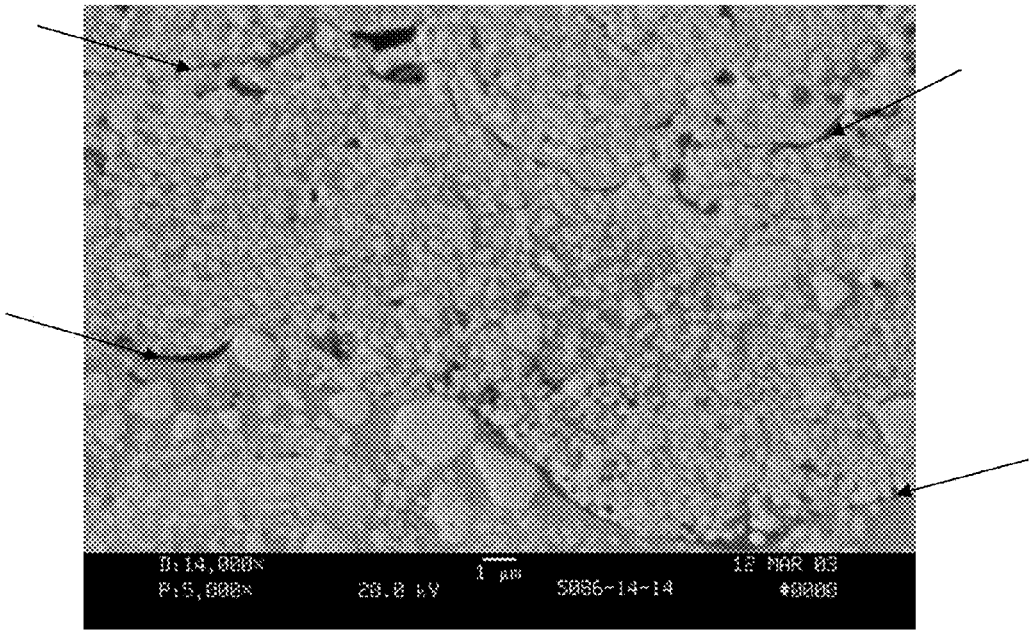
D:14,000x
P:5,000x
20.0 kV
1 μm
5086-14-14
12 MAR 03
#0000

THERMAL SPRAY COATED ROLLS FOR MOLTEN METAL BATHS

The present application claims priority from U.S. Provisional Application Ser. No. 60/725,631, filed Oct. 13, 2005, which is incorporated by reference herein in its entirety.

FIELD OF THE INVENTION

This invention relates to rolls for use in or in contact with molten metal comprising a roll drum having an outer peripheral surface and a thermally sprayed coating on the outer peripheral surface of said roll drum; a process for preparing the rolls; a method for forming a metal layer on a metal sheet utilizing the rolls, e.g., galvanization; and a thermal spray powder for coating the outer peripheral surface of the rolls.

BACKGROUND OF THE INVENTION

The steel industry places a high value on running galvanizing lines in a continuous manner. Significant losses (energy, capacity, productivity, etc.) are associated with down time in galvanizing zinc lines. Attack by molten zinc and the adherence of zinc dross limit the time hardware can be submerged in a zinc pot. Thermal spray coatings are used to coat submerged rolls in an effort to extend the time between maintenance shut-downs.

Galvanized steel sheets, including zinc-aluminum hot dipped steel sheets, are used as outer body panels for vehicles, corrosion resistant material for buildings and the like, and are manufactured by conventional galvanization processes.

In a typical galvanization process, a steel sheet is first annealed in a continuous annealing furnace, and then, the steel sheet, guided by a turn down roll, is introduced into a galvanizing bath, where the steel sheet is galvanized while passing along a sink roll, a front support roll and a back support roll. Thereafter, the galvanized steel sheet is passed through wiping nozzles, a touch roll and a top roll to adjust the thickness of the resulting galvanized layer.

In general, the rolls that are immersed in the galvanizing bath or are in contact with the high temperature galvanized steel sheet desirably satisfy the following conditions: the rolls are subject to only minimal erosion due to molten metal; the rolls are subject to only minimal abrasion by contact with the passing steel sheet; when the rolls are taken out of the galvanizing bath for maintenance and inspection, zinc easily peels off of the surface of the rolls; the rolls can be used over a long period of time; and the cost of the rolls is low.

U.S. Pat. No. 5,316,859 discloses a roll for continuous galvanization. The surface of the roll has a spray coated layer made from a cermet spraying material consisting essentially of WC—Co. The spray-coated layer consists of WC, at least one specified intermetallic compound and at least one amorphous W—C—Co compound and free C, but contains no free W and free Co.

Molten zinc resistant steels are basically iron base alloys and do not have enough resistance to molten zinc attack. The cost of those alloys are much higher than normal structural steels. Coatings such as self fluxing alloys and WC—Co are used as thermally sprayed coatings to protect substrates from attack by molten zinc, but sufficient resistance has not been achieved due to the permeation of molten zinc through interconnected porosity and selective attack on the metal binders.

There continues to be a need in the art for rolls that can be submerged in molten metal baths for long periods of time and thereby extend the time between maintenance shut-downs in, for example, galvanization processes. There also continues to be a need for rolls that have improved resistance to molten metal attack (such as molten zinc) and to adherence of dross.

SUMMARY OF THE INVENTION

This invention relates in part to a roll for use in or in contact with molten metal comprising a roll drum having an outer peripheral surface and a thermally sprayed coating on the outer peripheral surface of said roll drum, said thermally sprayed coating comprising from about 66 to about 88 weight percent of tungsten, from about 2.5 to about 6 weight percent of carbon, from about 6 to about 20 weight percent of cobalt, and from about 2 to about 9 weight percent of chromium.

This invention also relates in part to a process for preparing a roll for use in or in contact with molten metal comprising (i) providing a roll having an outer peripheral surface, and (ii) thermally spraying a coating onto the outer peripheral surface of said roll, said thermally sprayed coating comprising from about 66 to about 88 weight percent of tungsten, from about 2.5 to about 6 weight percent of carbon, from about 6 to about 20 weight percent of cobalt, and from about 2 to about 9 weight percent of chromium.

This invention further relates in part to a method for forming a metal layer on a metal sheet comprising (i) immersing the metal sheet in a molten metal bath, (ii) forming a metal layer on the metal sheet while passing the metal sheet along one or more submerged rolls in the molten metal bath, said one or more submerged rolls comprising a roll drum having an outer peripheral surface and a thermally sprayed coating on the outer peripheral surface of said roll drum; said thermally sprayed coating comprising from about 66 to about 88 weight percent of tungsten, from about 2.5 to about 6 weight percent of carbon, from about 6 to about 20 weight percent of cobalt, and from about 2 to about 9 weight percent of chromium, and (iii) removing the metal-layered metal sheet from the molten metal bath.

This invention yet further relates in part to a thermal spray powder for coating the outer peripheral surface of a roll for use in or in contact with molten metal comprising from about 66 to about 88 weight percent of tungsten, from about 2.5 to about 6 weight percent of carbon, from about 6 to about 20 weight percent of cobalt, and from about 2 to about 9 weight percent of chromium.

BRIEF DESCRIPTION OF THE DRAWINGS

FIG. 1 is a photomicrograph showing the microstructure of a coating of this invention at 5000× magnification. The coating splat boundaries show a fine oxide layer (arrows indicate thin dark regions, less than 1 micrometer thick).

DETAILED DESCRIPTION OF THE INVENTION

As indicated above, this invention relates in part to a thermal spray powder for coating the outer peripheral surface of a roll for use in or in contact with molten metal comprising from about 66 to about 88 weight percent of tungsten, from about 2.5 to about 6 weight percent of carbon, from about 6 to about 20 weight percent of cobalt, and from about 2 to about 9 weight percent of chromium.

Thermal spraying powders are provided that are capable of achieving thermal sprayed coatings having desired molten metal corrosion resistance, heat resistance, thermal shock resistance, oxidation resistance, and wear resistance, especially for rolls used in processes for plating molten metal in which a continuous strip of steel passes into a molten zinc or zinc alloy (e.g., zinc-aluminum alloy) bath and extends downward into the molten metal until it passes around a first submerged roll (commonly referred to as a pot or sink roll) and then proceeds upwardly in contact with a series of submerged rolls to stabilize the path of the strip through the molten bath. Also, methods of forming thermal sprayed coatings on the rolls are provided using such a thermal spraying powders.

The content of tungsten in the thermal spraying powder can range from about 66 to about 88 weight percent, preferably from about 76 to about 86 weight percent, and more preferably from about 78 to about 84 weight percent. If the content of tungsten is too low, the molten metal corrosion resistance, heat resistance, and wear resistance of the thermal sprayed coating may decrease. If the content of tungsten is too high, the toughness and adhesion of the thermal sprayed coating may decrease. As the toughness and adhesion of the thermal sprayed coating decrease, the thermal shock resistance of the thermal sprayed coating may also decrease.

The content of carbon in the thermal spraying powder can range from about 2.5 to about 6 weight percent, preferably from about 3 to about 5.5 weight percent, and more preferably from about 3.5 to about 5.2 weight percent. If the content of carbon is too low, the molten metal corrosion resistance, heat resistance, and wear resistance of the thermal sprayed coating may decrease. If the content of carbon is too high (causing the formation of too high a percentage of carbide phases), the toughness and adhesion of the thermal sprayed coating may decrease.

The content of cobalt in the thermal spraying powder can range from about 6 to about 20 weight percent, preferably from about 7 to about 13 weight percent, and more preferably from about 7 to about 11 weight percent. If the content of cobalt is too low, the toughness and adhesion of the thermal sprayed coating may decrease. If the content of cobalt is too high, the molten metal corrosion resistance and wear resistance of the thermal sprayed coating may decrease.

The content of chromium in the thermal spraying powder is from about 2 to about 9 weight percent, preferably from about 2.5 to about 7 weight percent, and more preferably from about 3 to about 6 weight percent. If the content of chromium is too low, the molten metal corrosion resistance, heat resistance, and oxidation resistance of the thermal sprayed coating may decrease. If the content of chromium is too high, the toughness and adhesion of the thermal sprayed coating may decrease.

In the galvanizing process, molten metal attacks the metallic binder phase of the thermal sprayed coating. The addition of chromium is an important modification of the composition, because chromium forms a tenacious oxide layer in the coating that acts as a barrier to molten metal corrosion. Chromium can be found in the thermal sprayed coating in many forms; as an oxide in the coating splat boundaries, as metallic alloy of cobalt in the coating binder phase, and potentially as a wear resistant complex carbide. The chromium oxide layer and the cobalt chromium binder phase both increase the time required for zinc to reach the roll base material. Zinc reaches the roll base in days or a few weeks for WCCo coated rolls without chromium and dross quickly forms on the coating surface causing defects in the galvanized steel sheet.

The total content of tungsten, carbon, cobalt and chromium in the thermal spraying powder should be no less than 97%. In the case where a thermal sprayed powder contains components other than tungsten, carbon, cobalt and chromium, the content of those other components in the thermal spraying powder is less than 3% by weight.

The average particle size of the thermal spraying powders useful in this invention is preferably set according to the type of thermal spray device and thermal spraying conditions used during thermal spraying. The particle size can range from about 1 to about 150 microns, preferably from about 5 to about 50 microns, and more preferably from about 10 to about 45 microns.

The average tungsten carbide grain size within the thermal spraying powder useful in this invention is preferably set according to the type of thermal spray device and thermal spraying conditions used during thermal spraying. The tungsten carbide grain size can range from about 0.1 to about 10 microns, preferably from about 0.2 to about 5 microns, and more preferably from about 0.3 to about 2 microns.

This invention further relates to starting with fine tungsten carbide grains within the thermal spray powder which fosters the formation of complex phases and effectively reduces the amount of elemental cobalt that the molten metal bath can attack. During the thermal spray process, some tungsten carbide grains can partially dissolve and alloy with the cobalt binder phase. If the tungsten carbide grains are too fine, too many may dissolve or decarburize causing the wear resistance of the thermal spray coating to be compromised.

The thermal spraying powders useful in this invention can be produced by conventional methods such as agglomeration (spray dry and sinter or sinter and crush methods) or cast and crush. In a spray dry and sinter method, a slurry is first prepared by mixing a plurality of raw material powders and a suitable dispersion medium. This slurry is then granulated by spray drying, and a coherent powder particle is then formed by sintering the granulated powder. The thermal spraying powder is then obtained by sieving and classifying (if agglomerates are too large, they can be reduced in size by crushing). The sintering temperature during sintering of the granulated powder is preferably 1000 to 1300° C.

The thermal spraying powders according to this invention may be produced by another agglomeration technique, sinter and crush method. In the sinter and crush method, a compact is first formed by mixing a plurality of raw material powders followed by compression and then sintered at a temperature between 1200 to 1400° C. The thermal spraying powder is then obtained by crushing and classifying the resulting sintered compact into the appropriate particle size distribution.

The thermal spraying powders according to this invention may also be produced by a cast (melt) and crush method instead of agglomeration. In the melt and crush method, an ingot is first formed by mixing a plurality of raw material powders followed by rapid heating, casting and then cooling. The thermal spraying powder is then obtained by crushing and classifying the resulting ingot.

In general, the thermal spraying powders can be produced by conventional processes such as the following:

(i) Spray Dry and Sinter method—WC, Co and Cr are mixed into a slurry and then spray granulated. The agglomerated powder is then sintered at a high temperature (at least 1000° C.) and sieved to a suitable particle size distribution for spraying;

(ii) Sinter and Crush method—WC, Co and Cr are sintered at a high temperature in a hydrogen gas or inert atmosphere (having a low partial pressure of oxygen) and then mechanically crushed and sieved to a suitable particle size distribution for spraying;

(iii) Cast and Crush method—WC, W, Co and Cr are fused in a crucible (a graphite crucible can be used to add C) and then the resulting casting is mechanically crushed and sieved;

(iv) Coated particle method—the surfaces of WC particles are subjected to Co and Cr plating; and (v) Densification method—the powder produced in any one of above process (i)-(iv) is heated by plasma flame or laser and sieved (plasma-densifying or laser-densifying process).

The average particle size of each raw material powder is preferably no less than 0.1 microns and more preferably no less than 0.2 microns, but preferably no more than 10 microns. If the average particle size of a raw material powder is too small, costs may increase. If the average particle size of a raw material powder is too large, it may become difficult to uniformly disperse the raw material powder.

The individual particles that compose the thermal spraying powder preferably have enough mechanical strength to stay coherent during the thermal spraying process. If the mechanical strength is too small, the powder particle may break apart clogging the nozzle or accumulate on the inside walls of the thermal spray device.

The coating process involves flowing powder through a thermal spraying device that heats and accelerates the powder onto a roll base (substrate). Upon impact, the heated particle deforms resulting in a thermal sprayed lamella or splat. Overlapping splats make up the coating structure. A detonation process useful in this invention is disclosed in U.S. Pat. No. 2,714,563, the disclosure of which is incorporated herein by reference. The detonation process is further disclosed in U.S. Pat. Nos. 4,519,840 and 4,626,476, the disclosures of which are incorporated herein by reference, which include coatings containing tungsten carbide cobalt chromium compositions. U.S. Pat. No. 6,503,290, the disclosure of which is incorporated herein by reference, discloses a high velocity oxygen fuel process useful in this invention to coat compositions containing W, C, Co, and Cr.

As also indicated above, this invention relates in part to a process for preparing a roll for use in or in contact with molten metal comprising (i) providing a roll having an outer peripheral surface, and (ii) thermally spraying a coating onto the outer peripheral surface of said roll, said thermally sprayed coating comprising from about 66 to about 88 weight percent of tungsten, from about 2.5 to about 6 weight percent of carbon, from about 6 to about 20 weight percent of cobalt, and from about 2 to about 9 weight percent of chromium.

In the coating formation step, the thermal spraying powder is thermally sprayed onto the surface of a roll, and as a result, a thermal sprayed coating is formed on the surface of the roll. High-velocity-oxygen-fuel or detonation gun spraying are the preferable methods of thermally spraying the thermal spraying powder. Other coating formation processes include plasma spraying, plasma transfer arc (PTA), flame spraying, or laser cladding.

In another embodiment of this invention, a method of forming a thermal sprayed coating is provided. The method includes preparing a thermal spraying powder containing from about 66 to about 88 weight percent of tungsten, from about 2.5 to about 6 weight percent of carbon, from about 6 to about 20 weight percent of cobalt, and from about 2 to about 9 weight percent of chromium; thermally spraying the thermal spraying powder onto a roll to form a thermal sprayed coating on the surface of the roll; and coating a sealing treatment agent onto the thermal sprayed coating formed on the surface of the roll, the sealing treatment agent containing boron-nitride-silicate. See, for example, U.S. Pat. No. 5,869,144, the disclosure of which is incorporated herein by reference.

In this embodiment, a sealing treatment agent is coated onto the thermal sprayed coating formed on the surface of the substrate in the aforementioned coating formation step. The sealing treatment agent is an agent containing boron nitride-silicate. The sealing treatment agent is applied by, for example, dipping, brush coating, or spraying. See, for example, U.S. Pat. No. 5,869,144.

The sealant, e.g., boron nitride-silicate, can provide excellent resistance to molten metal, especially molten zinc, and the sealant is preferably applied to the roll which contacts or is immersed in molten metal. Molten zinc attacks metals such as steel and the like and easily penetrates into small holes or gaps in the micrometer range because of its low surface tension and viscosity.

According to this invention, a boron nitride and silicate sealant is provided for thermally sprayed coated rolls intended to come into contact with or be immersed in a molten metal. The sealant provides resistance to molten metal attack and minimizes buildup of oxides, dross (i.e., an intermetallic alloy or compound of, but not limited to zinc, iron, aluminum and combinations thereof) and the like on the surface of the rolls. The boron nitride-silicate sealant is easy to apply and cost effective to produce.

The sealing material exhibits desired resistance to molten metal attack, such as molten zinc, and anti-wettability, thus making it ideally suitable for coating structural materials, such as rolls, that are intended to be used in or in contact with molten zinc or zinc alloys.

An illustrative sealant useful in this invention can be prepared as follows:

(a) preparing a water solution containing boron nitride and silicate;

(b) applying the solution on the thermally sprayed coated surface of the roll to be sealed; and (c) heating the coated roll in an appropriate temperature range to substantially remove the water from the coating.

Accordingly, this invention utilizes a sealant having an excellent resistance to molten metal, especially to molten zinc, and the sealant minimizes buildup of oxides, dross and the like when used in contact with a molten metal such as zinc. The sealant comprises an aqueous solution of boron nitride and silicate which can be applied to the surface of an article by painting, spraying, such as thermal spraying, or using any other conventional technique.

Preferably, the aqueous sealant solution can contain from about 6 to about 18 weight percent boron nitride solids (BN), from about 9 to about 26 weight percent silicide solids (total metal oxides+silica) and the balance water. More preferably, the aqueous sealant solution can contain from about 9 to about 15 weight percent boron nitride solids, from about 13 to about 24 weight percent silicide solids and the balance water.

After applying the aqueous solution to the roll, it should be dried to remove substantially all of the water. Preferably, the water in the coating should be reduced to 10% or less of the water used in the aqueous solution and preferably reduced to 5% or less of the water used in the aqueous solution. To insure removal of the water, the coated nitride could be heated above 100° C. for a time period to reduce the water in the coating to 5% or less. Generally, a time period of about 1 to about 10 hours would be sufficient, with a time period of about 4 to about 8 hours being preferred. It is preferable to heat the coated article above 212° F. since water in solution can not be effectively vaporized below 100° C. Excessive residual water can result in cracks in the sealant layer when it is rapidly heated up to the molten zinc temperature which is approximately 470° C.

Suitable silicate solutions can contain 26.5 weight percent $SiO_2$, 10.6 weight percent $Na_2O$ with the remainder water; 20.8 weight percent $K_2O$, 8.3 weight percent $SiO_2$ with the remainder water; and 28.7 weight percent $SiO_2$, 8.9 weight percent $Na_2O$ with the remainder water. It is also within the scope of this invention to use two different $M_2O$ components, such as a mixture of $Na_2O$ and $K_2O$.

Once the sealant is deposited on the thermally sprayed coated roll and the water is substantially removed, it can contain about 15 to about 70 weight percent boron nitride and about 30 to about 85 weight percent silicate, preferably about 31 to about 56 weight percent boron nitride and about 44 to about 69 weight percent silicate, and most preferably about 41.5 to about 47.5 weight percent boron nitride and about 52.5 to about 58.5 weight percent silicate. The boron nitride-silicate sealant will resist buildup of oxide and dross which generally adhere to the roll when in contact with a molten metal such as molten zinc. The amount of boron nitride should be sufficient to provide a non-stick surface while the silicate is used to maintain the boron nitride on the surface of the roll, thus sealing the roll from penetration of molten metal, such as molten zinc.

To enhance penetration of the sealant into the pores on the surface of the roll, a suitable wetting agent can be added such as various stearates, phosphates or common household detergents. Preferably an amount of about 2 weight percent or less would be sufficient for most applications. The boron nitride to be used can be highly pure or can be mixed with clays, aluminas, silica and carbon.

According to this invention, rolls intended for use with molten zinc are first thermal spray coated with a protective layer of tungsten carbide cobalt chromium. The sealant can then be deposited over the coating to prevent penetration of molten zinc to the substrate of the roll and also to minimize buildup of oxides and/or dross on the surface of the coated roll from the molten zinc.

The thermal sprayed coating formed by the thermal sprayed coating forming method according to this invention may have desired molten metal corrosion resistance, heat resistance, thermal shock resistance, oxidation resistance, and wear resistance.

It should be apparent to those skilled in the art that this invention may be embodied in many other specific forms without departing from the spirit of scope of the invention.

In an embodiment of this invention, a thermal spray coating is applied to the surface of a roll used for galvanization, wherein the coated roll has an excellent resistance to corrosion against molten zinc or Zn—Al molten alloy. The coated roll is effective for the formation of a galvanized layer on a steel sheet having improved galvanizing operation and high productivity. As a result of this invention, galvanized steel sheets may be produced having an excellent quality.

As indicated above, this invention relates in part to a roll for use in or in contact with molten metal comprising a roll drum having an outer peripheral surface and a thermally sprayed coating on the outer peripheral surface of said roll drum, said thermally sprayed coating comprising from about 66 to about 88 weight percent of tungsten, from about 2.5 to about 6 weight percent of carbon, from about 6 to about 20 weight percent of cobalt, and from about 2 to about 9 weight percent of chromium.

In an embodiment of the invention, the spray-coated layer has a thickness of about 0.02 to about 1 millimeter and a porosity of not more than about 5.0%. The spray-coated layer has a more preferable thickness of about 0.05 to about 0.5 millimeters and a porosity of not more than about 2.5%. The spray-coated layer has a most preferable thickness of about 0.07 to about 0.2 millimeters and a porosity of not more than about 1.5%. If the coating is too thin, dross will stick to the surface in a short amount of time. If the coating is too thick, thermal expansion stresses could lead to cracking.

The coated rolls of this invention can exhibit resistance to attack or corrosion from molten zinc yielding longer life for thermal spray coated rolls. Also, the thermal spray coating can be applied with a particular surface roughness to better hold a barrier coating for resisting the adherence of zinc dross.

Attack by molten zinc and the adherence of zinc dross limit the time hardware can be submerged in a zinc pot. The thermal spray materials of this invention are used to coat rolls that are submerged in molten metal baths in an effort to extend the time between maintenance shut-downs. The addition of chromium shows the ability to extend the life of the rolls.

Tungsten carbide cobalt chromium material applied by detonation or high velocity oxygen fuel processes can provide increased equipment life in galvanizing and galvanneal lines.

In a typical process for plating molten metal, a continuous strip of steel passes into a molten zinc or zinc alloy bath and extends downward into the molten metal until it passes around a first submerged roll (commonly referred to as a pot or sink roll) and then proceeds upwardly in contact with a series of submerged rolls to stabilize the path of the strip through the molten bath. In such a galvanizing process, the sink roll, as well as the stabilizing rolls, typically are supported by arms projecting along the sides of the molten metal pot into the bath of molten metal. The rolls themselves are, in turn, supported by bearing assemblies. These bearing assemblies generally comprise a sleeve mounted on the projecting end of the roll shaft and an oversized bearing element or bushing mounted on the end of the roll support arm.

The high temperature (ranging from about 419° C. to about 700° C.) of the molten zinc or zinc alloy coating bath, in combination with the high tensile loads required to be maintained in the strip to control its high speed movement through the plating apparatus, results in the rapid wearing of roll and roll bearing assemblies. With increased roll wear, molten metal attack of the rolls becomes more likely. The thermally sprayed coated rolls of this invention can exhibit excellent resistance to molten metal attack and anti-wettability.

As indicated above, this invention also relates to a method for forming a metal layer on a metal sheet comprising (i) immersing the metal sheet in a molten metal bath, (ii) forming a metal layer on the metal sheet while passing the metal sheet along one or more submerged rolls in the molten metal bath, said one or more submerged rolls comprising a roll drum having an outer peripheral surface and a thermally sprayed coating on the outer peripheral surface of said roll drum; said thermally sprayed coating comprising from about 66 to about 88 weight percent of tungsten, from about 2.5 to about 6 weight percent of carbon, from about 6 to about 20 weight percent of cobalt, and from about 2 to about 9 weight percent of chromium, and (iii) removing the metal-layered metal sheet from the molten metal bath.

In the thermal spray coated layer formed on the roll for galvanization, the thickness of the layer is an important factor. When the coated roll is immersed in a galvanizing bath at a high temperature and taken up therefrom, internal stress, based on the difference of thermal expansion coefficient between the coated layer and the roll substrate, is caused in accordance with the thermal change. As the difference of thermal expansion coefficient becomes large, the coated layer is apt to be peeled off from the roll substrate. Particularly, a part of the coated layer can be scattered off from the roll substrate, which is so-called chipping. Thus, when the thickness of the coated layer is too thick, it is easily peeled off from the roll substrate due to the difference in thermal expansion coefficient; while when the thickness is too thin, the pores are easily formed and hence hot zinc easily penetrates into the inside of the coated layer to lower the resistance to galvanizing bath solution.

According to this invention, the thickness of the thermal sprayed coated layer can range from about 0.01 to about 2.0 millimeters. When the thickness is outside the above range, the coated layer may peel off, and also the cost thereof may increase together with the rise of the spraying material cost.

According to this invention, the thermal sprayed layer can consist of metal carbides, $M_xC$ (where M represents metal and is one or more of the following elements; W, Co and Cr); metallic binder, CoCr (free Co and Co in solution with Cr); and a protective $Cr_2O_3$ layer that can protect the carbides, binder, and resultant particle splat boundaries. The $M_xC$ phases can consist of MC, $M_2C$, $M_6C$, $M_9C$ and $M_{12}C$; resulting in carbide formulations within the $W_xCo_yCr_zC$ family. The predominate carbide phases of this invention are WC, major, and $W_2C$, minor, (x=1 or 2, y and z=0). Complex carbide phases are difficult to observe, but could be present in small amounts especially in the regions where the major or minor carbide phase has been dissolved into the metal matrix. Carbides that precipitate out of solution can contain Co and Cr. This thermal sprayed layer is formed on a surface of a roll used in the galvanization process. According to this invention, this spray coated layer can exhibit corrosion resistance to hot zinc or a galvanizing bath containing about 0.05 to about 5 weight % of Al. By using such a thermal spray coated layer, there can be provided a stable galvanizing operation, high productivity and improvement of quality in the galvanized and galvannealed steel sheet.

The following examples are provided to further describe the invention. The examples are intended to be illustrative in nature and are not to be construed as limiting the scope of the invention.

EXAMPLES

The examples listed in Table I below are thermal sprayed coatings applied to dip samples that were placed in galvanizing and galvanneal baths (molten zinc with slight additions of Al, less than 5%) during the manufacture of steel sheet. The coatings were applied by a detonation process or by a high velocity oxygen fuel (HVOF) process. All of the dip samples had a sealer treatment that included boron nitride as described herein. The examples are listed in Table I showing composition (weight percent), thermal spray process, powder manufacture method (including starting tungsten carbide size), qualitative performance based on zinc and dross adherence, and additional comments.

TABLE I

| Composition | Process | Powder | Performance | Comments |
|---|---|---|---|---|
| A.) 85 W, 11 Co, 4 C | Detonation | Cast & Crush 1-10 μm carbides | Good | Limited Life |
| B.) 87 Cr, 13 C | Detonation | Sinter & Crush 1-10 μm carbides | Mixed | Cracking Issues |
| C.) 48 Cr, 34 W, 12 Co, 4C | HVOF | Atomization 0.5-5 μm carbides | Poor | Corrosive Attack of Roll Base |
| D.) 40 W, 36 Cr, 20 Co, 4 C | HVOF | Atomization 0.5-5 μm carbides | Poor | Coating Spallation |
| E.) 81 W, 10 Co, 4 Cr, 5C | Detonation | Aggl & Sinter 1-3 μm carbides | Very Good | Little or No Dross |
| F.) 83 W, 12 Co, 5 C | Detonation | Aggl & Sinter 1-3 μm carbides | Good | Limited Life |
| G.) 81 W, 10 Co, 4 Cr, 5 C | HVOF | Aggl & Sinter 1-3 μm carbides | Good/Very Good | Little or No Dross |
| H.) 81 W, 10 Co, 4 Cr, 5 C | HVOF | Aggl & Sinter 0.5-1 μm carbides | Very Good | Little or No Dross |
| I.) 81 W, 8 Co, 6 Cr, 5 C | HVOF | Aggl & Sinter 0.5-1 μm carbides | Very Good | Little or No Dross |
| J.) 93 $ZrO_2$, 7 $Y_2O_3$ | Detonation | Aggl & Sinter 1-3 μm oxides | Good | Future Work |

As shown in Table I, WC-10Co-4Cr and WC-8Co-6Cr applied by HVOF (JP-5000 gun) and detonation gun (examples E, G, H and I) were not wet by molten zinc (with 0.1-0.25% Al), and zinc or dross (iron aluminides) did not stick to the coated surfaces of the rods. A control sample coated with WC-11Co applied by detonation gun (standard offering), was covered in zinc.

Besides the degree of resistance to molten zinc exhibited by the coatings, the WCCoCr coatings of this invention may have a particular surface (surface roughness and oxide content) that allows better adherence of the sealer or barrier coating.

While there has been shown and described what are considered to be preferred embodiments of the invention, it will, of course, be understood that various modifications and changes in form or detail could readily be made without departing from the spirit and scope of the invention. It is, therefore, intended that the invention be not limited to the exact form and detail herein shown and described, nor to anything less than the whole of the invention herein disclosed as hereinafter claimed.

The invention claimed is:

1. A roll for use in or in contact with molten metal comprising a roll drum having an outer peripheral surface and a thermally sprayed coating on the outer peripheral surface of said roll drum, wherein said thermally sprayed coating is thermal sprayed from a thermal spray powder, said thermally sprayed coating comprising from about 66 to about 88 weight percent of tungsten, from about 2.5 to about 6 weight percent of carbon, from about 6 to about 20 weight percent of cobalt, and from about 2 to about 9 weight percent of chromium; wherein said thermal spray powder has a particle size from about 5 to about 50 microns and a tungsten carbide grain size of from about 0.1 to about 2 microns; wherein said thermally sprayed coating comprises (i) a chromium oxide layer in at least a portion of splat boundaries, and (ii) a cobalt chromium binder phase, sufficient to increase the time required for said molten metal to wear said thermally sprayed coating and reach said roll drum; and wherein said thermally sprayed coating has a porosity of not greater than about 2.0%.

2. The roll of claim 1 wherein the thermally sprayed coating comprises from about 76 to about 86 weight percent of tungsten, from about 3 to about 5.5 weight percent of carbon, from about 7 to about 13 weight percent of cobalt, and from about 2.5 to about 7 weight percent of chromium.

3. The roll of claim 1 wherein the thermally sprayed coating has a thickness of from about 0.01 to about 2.0 millimeters.

4. The roll of claim 1 wherein said thermally sprayed coating has a surface roughness sufficient for adhering a barrier coating onto the thermally sprayed coating.

5. The roll of claim 1 further comprising a sealing treatment coating on the thermal sprayed coating formed on the outer peripheral surface of the roll.

6. The roll of claim 5 in which the sealing treatment coating comprises a boron-nitride-silicate coating.

7. The roll of claim 1 wherein said thermally sprayed coating is formed by a plasma coating method, a high-velocity oxygen fuel coating method or a detonation coating method.

8. The roll of claim 1 for use in galvanization.

9. The roll of claim 1 wherein the thermally sprayed coating is sufficient to exhibit corrosion resistance to hot zinc or a galvanizing bath containing about 0.05 to about 5 weight % of Al.

10. The roll of claim 1 wherein the thermal spray powder has a Co particle size of from about 0.1 to about 10 microns.

11. A roll for use in or in contact with molten metal comprising a roll drum having an outer peripheral surface and a thermally sprayed coating on the outer peripheral surface of said roll drum, wherein said thermally sprayed coating is thermal sprayed from a thermal spray powder, said thermal spray powder comprising from about 66 to about 88 weight percent of tungsten, from about 2.5 to about 6 weight percent of carbon, from about 6 to about 20 weight percent of cobalt, and from about 2 to about 9 weight percent of chromium;

wherein said thermal spray powder has a particle size from about 5 to about 50 microns, a cobalt particle size of from about 0.1 to about 10 microns, and a tungsten carbide grain size of from about 0.1 to about 2 microns; wherein said thermally sprayed coating comprises (i) a chromium oxide layer in at least a portion of splat boundaries, and (ii) a cobalt chromium binder phase, sufficient to increase the time required for said molten metal to wear said thermally sprayed coating and reach said roll drum; and wherein said thermally sprayed coating has a porosity of not greater than about 2.0%.

12. The roll of claim 11 wherein the thermal spray powder comprises from about 76 to about 86 weight percent of tungsten, from about 3 to about 5.5 weight percent of carbon, from about 7 to about 13 weight percent of cobalt, and from about 2.5 to about 7 weight percent of chromium.

13. A roll for use in or in contact with molten metal comprising a roll drum having an outer peripheral surface and a thermally sprayed coating on the outer peripheral surface of said roll drum, wherein said thermally sprayed coating is thermal sprayed from a thermal spray powder, said thermally sprayed coating comprising (i) one or more metal carbides represented by the formula $M_xC$ wherein M is one or more of W, Co and Cr, (ii) a metallic binder comprising CoCr, and (iii) a $Cr_2O_3$ layer in at least a portion of splat boundaries to protect said metal carbides and said metallic binder; wherein said thermal spray powder has a particle size from about 5 to about 50 microns and a metal carbide grain size of from about 0.1 to about 2 microns; and wherein said thermally sprayed coating has a porosity of not greater than about 2.0%.

14. The roll of claim 13 wherein said thermal spray powder comprises from about 66 to about 88 weight percent of tungsten, from about 2.5 to about 6 weight percent of carbon, from about 6 to about 20 weight percent of cobalt, and from about 2 to about 9 weight percent of chromium.

15. The roll of claim 13 wherein the thermal spray powder comprises from about 76 to about 86 weight percent of tungsten, from about 3 to about 5.5 weight percent of carbon, from about 7 to about 13 weight percent of cobalt, and from about 2.5 to about 7 weight percent of chromium.

16. The roll of claim 13 wherein the thermally sprayed coating is sufficient to exhibit corrosion resistance to hot zinc or a galvanizing bath containing about 0.05 to about 5 weight % of Al.

17. The roll of claim 13 wherein the thermal spray powder has a Co particle size of from about 0.1 to about 10 microns.

18. The roll of claim 13 wherein $M_xC$ comprises MC, $M_2C$, $M_6C$, $M_9C$ and $M_{12}C$ phases.

19. The roll of claim 13 wherein MC is a major phase and $M_2C$ a minor phase.

20. The roll of claim 13 wherein WC is a major phase and $W_2C$ a minor phase.

21. A roll for use in or in contact with hot zinc or a galvanizing bath containing about 0.05 to about 5 weight % of Al, said roll comprising a roll drum having an outer peripheral surface and a thermally sprayed coating on the outer peripheral surface of said roll drum, wherein said thermally sprayed coating is thermal sprayed from a thermal spray powder, said thermally sprayed coating comprising from about 66 to about 88 weight percent of tungsten, from about 2.5 to about 6 weight percent of carbon, from about 6 to about 20 weight percent of cobalt, and from about 2 to about 9 weight percent of chromium; wherein said thermal spray powder has a particle size from about 5 to about 50 microns and a tungsten carbide grain size of from about 0.1 to about 5 microns; wherein said thermally sprayed coating comprises (i) a chromium oxide layer in at least a portion of splat boundaries, and (ii) a cobalt chromium binder phase; wherein said thermally sprayed coating increases the time required for said hot zinc or a galvanizing bath containing about 0.05 to about 5 weight % of Al to wear said thermally sprayed coating and reach said roll drum; and wherein said thermally sprayed coating has a porosity of not greater than about 2.0%.

22. A roll for use in or in contact with hot zinc or a galvanizing bath containing about 0.05 to about 5 weight % of Al, said roll comprising a roll drum having an outer peripheral surface and a thermally sprayed coating on the outer peripheral surface of said roll drum, wherein said thermally sprayed coating is thermal sprayed from a thermal spray powder, said thermal spray powder comprising from about 66 to about 88 weight percent of tungsten, from about 2.5 to about 6 weight percent of carbon, from about 6 to about 20 weight percent of cobalt, and from about 2 to about 9 weight percent of chromium; wherein said thermal spray powder has a particle size from about 5 to about 50 microns, a cobalt particle size of from about 0.1 to about 10 microns, and a tungsten carbide grain size of from about 0.1 to about 5 microns; wherein said thermally sprayed coating comprises (i) a chromium oxide layer in at least a portion of splat boundaries, and (ii) a cobalt chromium binder phase; wherein said thermally sprayed coating increases the time required for said hot zinc or a galvanizing bath containing about 0.05 to about 5 weight % of Al to wear said thermally sprayed coating and reach said roll drum; and wherein said thermally sprayed coating has a porosity of not greater than about 2.0%.

23. A roll for use in or in contact with hot zinc or a galvanizing bath containing about 0.05 to about 5 weight % of Al, said roll comprising a roll drum having an outer peripheral surface and a thermally sprayed coating on the outer peripheral surface of said roll drum, wherein said thermally sprayed coating is thermal sprayed from a thermal spray powder, said thermally sprayed coating comprising (i) one or more metal carbides represented by the formula $M_xC$ wherein M is one or more of W, Co and Cr, (ii) a metallic binder comprising CoCr, and (iii) a $Cr_2O_3$ layer in at least a portion of splat boundaries to protect said metal carbides and said metallic binder; wherein said thermal spray powder has a particle size from about 5 to about 50 microns and a metal carbide grain size of from about 0.1 to about 5 microns; wherein said thermally sprayed coating increases the time required for said hot zinc or a galvanizing bath containing about 0.05 to about 5 weight % of Al to wear said thermally sprayed coating and reach said roll drum; and wherein said thermally sprayed coating has a porosity of not greater than about 2.0%.

* * * * *